US009956495B2

(12) United States Patent
Kamiyama et al.

(10) Patent No.: US 9,956,495 B2
(45) Date of Patent: May 1, 2018

(54) DECORATIVE BEAD TOY AND BEAD TOY SET

(71) Applicant: EPOCH COMPANY, LTD., Tokyo (JP)

(72) Inventors: Kei Kamiyama, Tokyo (JP); Ryo Sakai, Chiba (JP)

(73) Assignee: EPOCH COMPANY, LTD., Tokyo (JP)

( * ) Notice: Subject to any disclaimer, the term of this patent is extended or adjusted under 35 U.S.C. 154(b) by 0 days. days.

(21) Appl. No.: 15/423,648

(22) Filed: Feb. 3, 2017

(65) Prior Publication Data

US 2017/0246551 A1 Aug. 31, 2017

(30) Foreign Application Priority Data

Feb. 29, 2016 (JP) ..... 2016-037517

(51) Int. Cl.

| | |
|---|---|
| ***A63H 33/14*** | (2006.01) |
| ***B44C 3/12*** | (2006.01) |
| ***A63F 9/06*** | (2006.01) |
| ***A63H 33/00*** | (2006.01) |

(52) U.S. Cl.

CPC ..... *A63H 33/14* (2013.01); *A63F 9/06* (2013.01); *A63H 33/001* (2013.01); *B44C 3/12* (2013.01)

(58) Field of Classification Search

CPC ..... A63F 9/06; B44C 3/12; A63H 33/001; A63H 33/14

USPC ..... 446/87; 156/63; 273/157 R; 434/96

See application file for complete search history.

(56) References Cited

U.S. PATENT DOCUMENTS

| | | | | |
|---|---|---|---|---|
| 3,987,558 | A * | 10/1976 | Tsukamoto | A63H 33/22 273/157 R |
| 4,170,425 | A * | 10/1979 | Brown | F16B 12/14 403/296 |
| 5,447,584 | A * | 9/1995 | Shakespeare | A63H 33/14 156/256 |
| 5,704,789 | A * | 1/1998 | Yang | B44C 3/123 221/185 |
| 9,624,407 | B1 * | 4/2017 | Phillips, III | C09J 103/02 |
| 2002/0102905 | A1 * | 8/2002 | Tseng | A63H 33/001 446/131 |
| 2008/0011770 | A1 * | 1/2008 | Tobias | B44B 9/00 221/189 |

(Continued)

FOREIGN PATENT DOCUMENTS

| | | |
|---|---|---|
| CN | Y-201052418 | 4/2008 |
| CN | Y-201201471 | 3/2009 |

(Continued)

OTHER PUBLICATIONS

JP Notification of Reasons for Refusal dated Oct. 6, 2016 for JP 2016-037517, including English translation.

(Continued)

*Primary Examiner* — Alexander Niconovich

(74) *Attorney, Agent, or Firm* — Drinker Biddle & Reath LLP

(57) ABSTRACT

A decorative bead toy includes: a body portion formed into a granular shape and made of a water insoluble material; and a recess engagement portion provided in the body portion so as to engage a plurality of fusible bead toys made of water soluble resin. The recess engagement portion is formed into an annular shape.

4 Claims, 3 Drawing Sheets

(56) References Cited

U.S. PATENT DOCUMENTS

| | | | | |
|---|---|---|---|---|
| 2010/0311299 | A1* | 12/2010 | Rath | A63H 33/14 446/87 |
| 2013/0183881 | A1* | 7/2013 | Kamiyama | B44C 3/12 446/87 |
| 2014/0120501 | A1* | 5/2014 | Cooke | A63F 9/06 434/81 |
| 2016/0271510 | A1* | 9/2016 | Ho | A63H 33/14 |
| 2016/0354705 | A1* | 12/2016 | Poulus | A63H 33/14 |
| 2017/0087480 | A1* | 3/2017 | Poulus | A63H 33/086 |
| 2017/0246551 | A1* | 8/2017 | Kamiyama | A63H 33/14 |

FOREIGN PATENT DOCUMENTS

| | | | |
|---|---|---|---|
| CN | A-101439233 | | 5/2009 |
| JP | S53-61388 | U | 5/1978 |
| JP | S62-97900 | A | 5/1987 |
| JP | 3131292 | U | 4/2007 |
| JP | A-2009-125232 | | 6/2009 |
| JP | 2013-143986 | A | 7/2013 |
| JP | A-2005-181915 | | 10/2015 |

OTHER PUBLICATIONS

DE Office Action 102017104056.0 dated Mar. 15, 2017, along with its partial English-language translation, attached.
GB Office Action 1702790.5 dated Jun. 26, 2017.
A Korean Office Action dated Jun. 15, 2017 that issued in corresponding Korean patent application No. 10-2017-0023931 (with attached Enlish-language translation).
CN Office Action dated Dec. 28, 2017 from corresponding Chinese patent application No. 201710113992.2 (with attached English-language translation).

* cited by examiner

DECORATIVE BEAD TOY AND BEAD TOY SET

CROSS-REFERENCES TO RELATED APPLICATIONS

This application is based upon and claims priority from Japanese Patent Application No. 2016-037517 filed on Feb. 29, 2016, the entire contents of which are incorporated herein by reference.

FIELD

One or more embodiments of the present invention relate to a decorative bead toy to be used together with fusible bead toys made of water soluble resin, and a bead toy set provided with the decorative bead toy.

BACKGROUND

Fusible bead toys made of water soluble resin and having various shapes have been provided. For example, in a bead toy set described in JP-U-3131292, fusible beads made of water soluble resin and having spherical shapes are disclosed. In addition, JP-A-2013-143986 discloses a fusible bead toy made of water soluble resin and having a transparent polyhedral shape.

For example, these fusible bead toys can be played with as follows. First, fusible bead toys prepared in a plurality of colors are placed on a holding tray to draw a desired design. Recess portions have been formed in the holding tray. On this occasion, the fusible bead toys are in contact with one another. When water is poured on the fusible bead toys after the fusible bead toys are placed on the holding tray, the fusible bead toys are made wet. As a result, the fusible bead toys are fused so that the fusible bead toys in contact with one another can be connected to one another. When the fusible bead toys are dried as they are, the fusible bead toys are hardened in a state where they have been connected to one another. Alternatively, the fusible bead toys put on one another may be hardened. In this manner, a user can enjoy creating and playing with an assembly of fusible bead toys with a desired picture pattern or a desired shape.

SUMMARY

The assembly of fusible bead toys created may be played with, for example, as an accessory toy. In such a case, the user may want to more enjoyably play with the assembly of fusible bead toys combined with highly decorative bead toys such as bead toys made of glass or bead toys subjected to plating treatment. However, a bead toy made of a water insoluble material such as glass or resin subjected to plating treatment and a fusible bead toy made of water soluble resin cannot be fused with each other. Therefore, even when the fusible bead toy is dried, those bead toys are not hardened in a state where they have been connected to each other. Accordingly, it is not easy to incorporate a decorative bead toy made of a water insoluble material into an assembly of fusible bead toys.

An object of one or more embodiments of the invention is to provide a bead toy that can be played together with fusible bead toys made of water soluble resin.

A decorative bead toy according to an aspect of the invention includes: a body portion formed into a granular shape and made of a water insoluble material; and a recess engagement portion provided in the body portion so as to engage a plurality of fusible bead toys made of water soluble resin, wherein the recess engagement portion is formed into an annular shape.

A bead toy set according to another aspect of the invention includes: the above-described decorative bead toy; a fusible bead toy made of water soluble resin; and a holding tray having a plurality of recess portions on which the decorative bead toy and the fusible bead toy are allowed to be placed.

According to the above-described aspects, a plurality of fusible bead toys made of water soluble resin can be hardened in a state where the fusible bead toys have engaged a decorative bead toy made of a water insoluble material. Consequently, it is possible to easily incorporate the decorative bead toy into a bead toy assembly. In this manner, it is possible to provide a decorative bead toy and a bead toy set that can be played together with fusible bead toys made of water soluble resin.

DETAILED DESCRIPTION

Figure 1:
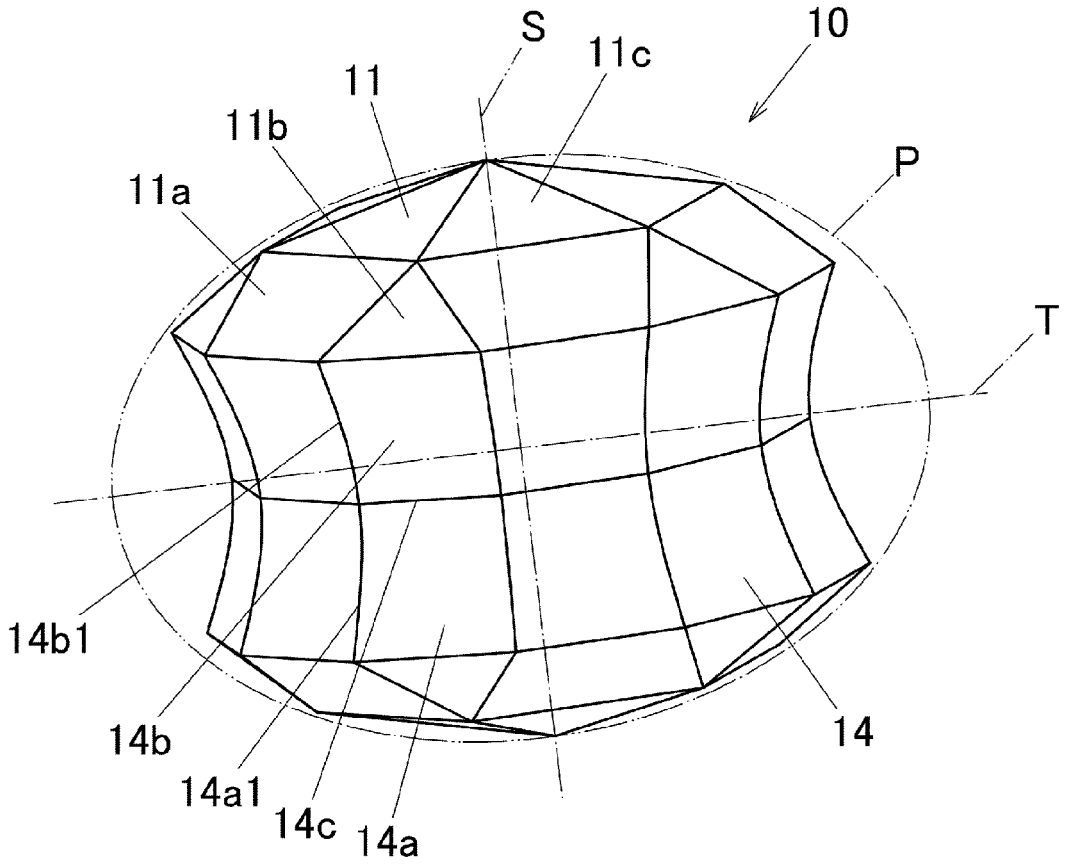
FIG. 1 is a perspective view showing a decorative bead toy according to an embodiment of the invention.

Next, an embodiment of the invention will be described with reference to the drawings. As shown in FIG. 1, a body portion 11 of a decorative bead toy 10 is formed into a granular shape. The body portion 11 is formed by cutting a spheroid (more in detail, an oblate ellipsoid) into a multifaceted shape. The spheroid uses a minor axis S of an ellipse P as a rotational axis. A groove portion 14 serving as a recess engagement portion is formed into an annular shape around an equatorial radius of the body portion 11. Both the body portion 11 and the groove portion 14 are formed into multifaceted shapes having a large number of faces, which are made into quadrangles, triangles or trapezoid. More in detail, the surface of the body portion 11 has a large number of trapezoidal faces 11*a* having one and the same shape, and a large number of triangular faces 11*b* and 11*c* having one and the same shape. The groove portion 14 has a large number of quadrangular faces 14*a* and 14*b* having one and the same shape. In each quadrangular face 14*a*, 14*b*, sides 14*a*1, 14*b*1 in the direction of the minor axis S are formed into convex curved shapes toward the inner diameter of the body portion 11. A connection side 14*c* between the lower face 14*a* of the groove portion 14 and the upper face 14*b* of the groove portion 14 in FIG. 1 is located on a plane formed when a major axis T of the ellipse P is rotated around the minor axis S. In this manner, the groove portion 14 is formed as a recess groove having a curved shape in longitudinal section.

The decorative bead toy 10 (body portion 11) is made of resin, which is a water insoluble material. Specifically, the decorative bead toy 10 is made of ABS resin. Further, the body portion 11 and the groove portion 14 are plated on the resin. Consequently, the surface of the decorative bead toy 10 is formed in color such as gold or silver with high reflectivity.

Figure 2:
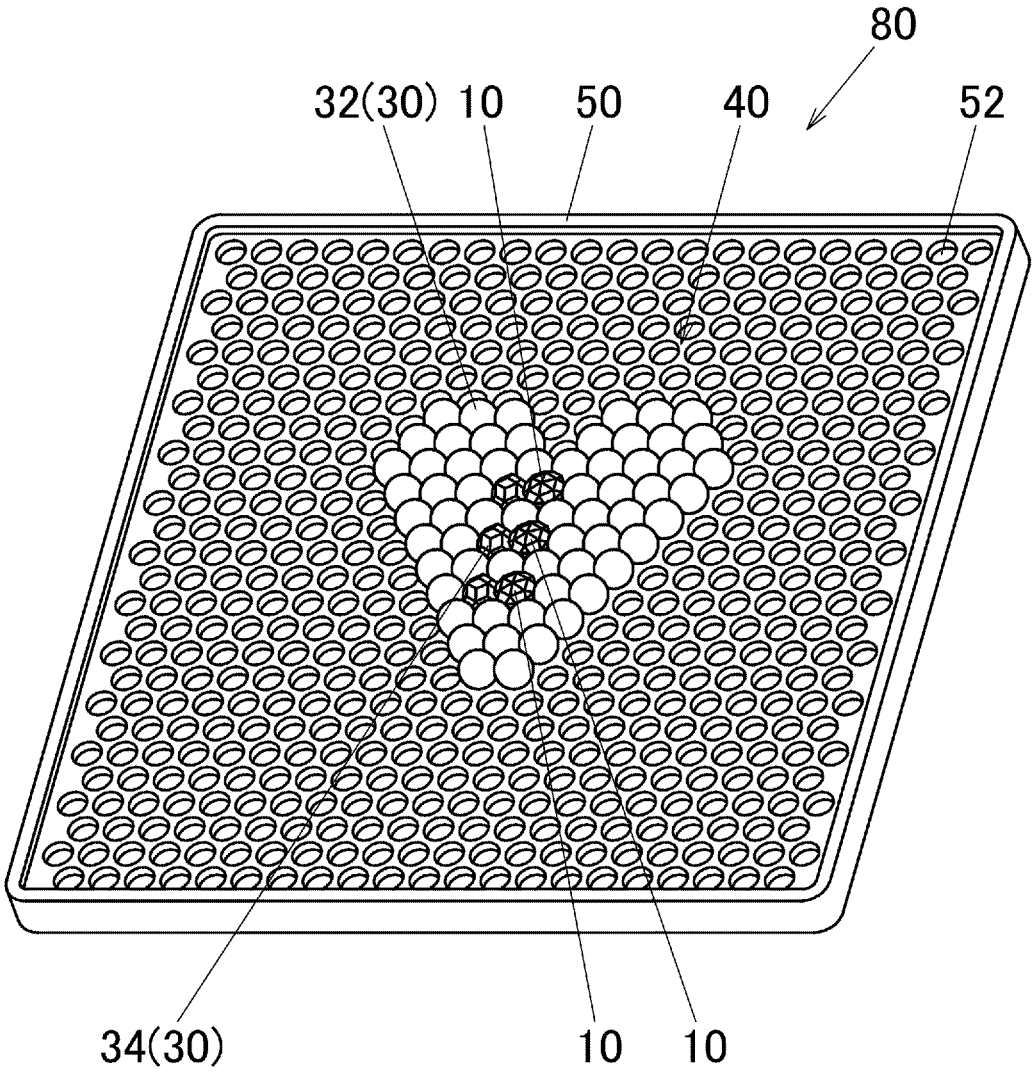
FIG. 2 is a perspective view showing an example of a bead toy set according to the embodiment of the invention, and showing a state in which spherical fusible bead toys, polyhedral fusible bead toys and decorative bead toys are placed on a holding tray.

FIG. 2 shows a bead toy set 80 including decorative bead toys 10 shown in FIG. 1. The bead toy set 80 includes fusible bead toys 30 made of water soluble resin. The fusible bead toys 30 include spherical bead toys 32 and polyhedral bead toys 34. Further, the bead toy set 80 includes a holding tray 50.

Known ones are used as the fusible bead toys 30 (the spherical bead toys 32 and the polyhedral bead toys 34). For example, for the fusible bead toys 30, polyvinyl alcohol mixed into resin may be kneaded and formed into spherical shapes or polyhedral shapes.

The holding tray 50 is an example of a known holding tray 50 in the same manner as the fusible bead toys 30. The holding tray 50 is formed into a quadrangular plate-like shape. A plurality of circular recess portions 52 are provided in the surface of the holding tray 50. The recess portions 52 are disposed to be offset from one row (or column) to another. Consequently, six fusible bead toys 30 can be placed around one fusible bead toy 30 placed on a recess portion 52. In addition, the diameter of each recess portion 52 is formed to be smaller than the diameter of each fusible bead toy 30, while a distance between centers of recess portions 52 adjacent to each other is set so that fusible bead toys 30 disposed in the recess portions 52 adjacent to each other can be disposed in contact with each other or at a shortest distance from each other not to contact with each other. Incidentally, another known holding tray has a round shape or the like, and in another known holding tray, recess portions are disposed not to be offset as described above but to be parallel with one another.

The bead toy set 80 is played with as follows. First, a plurality of fusible bead toys 30 (spherical bead toys 32 and polyhedral bead toys 34) and decorative bead toys 10 are disposed with a shape drawing a desired design. On this occasion, it is preferable that the decorative bead toys 10 and the fusible bead toys 30 are disposed in such a manner that fusible bead toys 30 are disposed radially at six places around one decorative bead toy 10. In the example of FIG. 2, the fusible bead toys 30 and the decorative bead toys 10 are disposed like a heart shape as a whole, to thereby form a bead toy assembly 40.

Figure 3:
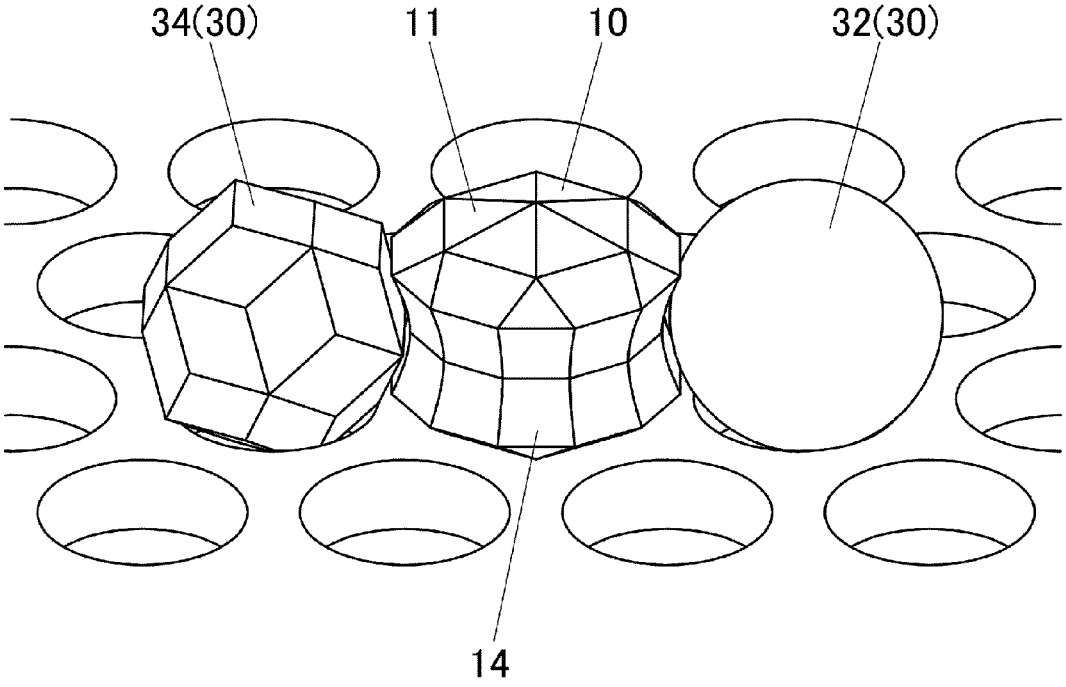
FIG. 3 is a perspective view showing a state in which fusible bead toys have been placed on opposite sides of a decorative bead toy according to the embodiment of the invention.

When fusible bead toys 30 are disposed around a decorative bead toy 10, the fusible bead toys 30 engage the groove portion 14 of the decorative bead toy 10. The groove portion 14 serves as a recess engagement portion. As shown in FIG. 3, the fusible bead toys 30 engage the groove portion 14 of the decorative bead toy 10. To say other words, a part of the surface of each fusible bead toy 30 is in contact with the groove portion 14.

When the bead toy assembly 40 disposed in a heart shape on the holding tray 50 is poured with water by a sprayer or the like on, the surfaces of the fusible bead toys 30 are fused so that the fusible bead toys 30 can be connected to one another. On this occasion, excessive water falls down to the recess portions 52 of the holding tray 50 and is stored therein. When the bead toy assembly 40 poured with water is dried as it is, the fusible bead toys 30 are hardened in a state where they have been connected to one another. Consequently, the bead toy assembly 40 arranged on the holding tray 50 is hardened like a heart-shaped plate.

On the other hand, the decorative bead toys 10 cannot be fused even if water is poured thereon. Accordingly, any fusible bead toy 30 and any decorative bead toy 10 cannot be connected to each other even if they are adjacent to each other. However, fusible bead toys 30 around each decorative bead toy 10 are connected to one another and hardened. The fusible bead toys 30 engage the groove portion 14 of the decorative bead toy 10. In this manner, each decorative bead toy 10 can be held firmly by a plurality of fusible bead toys 30 hardened around the decorative bead toy 10.

According to the embodiment of the invention, it is possible to provide a decorative bead toy and a bead toy set as follows.

A decorative bead toy according to a first aspect includes: a body portion formed into a granular shape and made of a water insoluble material; and a recess engagement portion provided in the body portion so as to engage a plurality of fusible bead toys made of water soluble resin.

According to this configuration, a plurality of fusible bead toys made of water soluble resin can engage the recess engagement portion of the body portion of the decorative bead toy. Accordingly, when water is poured on the fusible bead toys engaging the recess engagement portion of the body portion of the decorative bead toy, the fusible bead toys can be connected to one another and hardened as they are. Consequently, the decorative bead toy is held in an assembly of the fusible bead toys. In this manner, the decorative bead toy made of a water insoluble material that cannot be hardened to be connected to the fusible bead toys made of water soluble resin can be incorporated into the bead toy assembly. Therefore, a user can create a highly decorative assembly of bead toys, and play with the assembly more enjoyably.

In a decorative bead toy according to a second aspect, the recess engagement portion is formed into an annular shape.

According to this configuration, fusible bead toys can be disposed densely around the decorative bead toy. Therefore, the decorative bead toy can be held more firmly by the fusible bead toys.

In a decorative bead toy according to a third aspect, the body portion and the recess engagement portion are formed into multifaceted shapes.

According to this configuration, the decorative bead toy can be formed into a diamond-cut shape or the like. Therefore, it is possible to provide a decorative bead toy with increased decorativeness.

In a decorative bead toy according to a fourth aspect, the body portion is made of water insoluble resin, and the body portion and the recess engagement portion are plated on the resin.

According to this configuration, it is possible to provide a decorative bead toy with decorativeness enhanced by plating on the resin using a resin material that can be manufactured comparatively easily.

In a decorative bead toy according to a fifth aspect, the body portion is formed into a spheroid using a minor axis as a rotational axis, and the recess engagement portion is provided around an equatorial radius of the body portion formed into the spheroid.

According to this configuration, the decorative bead toy can be formed into an oblate ellipsoid. Accordingly, the size of an outer surface of the decorative bead toy can be increased. Therefore, when the decorative bead toy is incorporated into a bead toy assembly, the decorative bead toy can be made more conspicuous.

A bead toy set according to a sixth aspect includes: decorative the bead toy according to any one of the first to fifth aspects; a fusible bead toy made of water soluble resin; and a holding tray having a plurality of recess portions on which the decorative bead toy and the fusible bead toy are allowed to be placed.

According to this configuration, an assembly of bead toys with enhanced decorative effect can be created only if the bead toys are poured with water and dried. Therefore, even a child can enjoy creating a bead toy assembly easily by himself/herself and playing therewith.

Although the embodiment of the invention has been described above, the invention is not limited to the above-described embodiment. Various changes may be made without departing from the scope of the invention.

For example, the recess engagement portion does not have to be formed into a continuously annular shape. For example, a plurality of recess portions may be disposed in the surface of the body portion 11 so as to serve as the recess engagement portion. Alternatively, a plurality of convex portions may be formed on the surface of the body portion 11 so that recess portions among the convex portions can serve as the recess engagement portion. In addition, the body portion 11 may be formed into another shape as long as it is granular. Specifically, the body portion 11 can be formed into various granular shapes including a star shape, a toroidal shape, a rhombus, a pyramid such as a trigonal pyramid, a polygonal prism, a cylindrical shape, etc.

In addition, the groove portion 14 may have any form as long as a plurality of fusible bead toys made of water soluble resin can engage the groove portion 14. The groove portion 14 can be formed into various shapes such as a recess portion, a waved shape, etc. In addition, the body portion 11 may be made of any material as long as it is a water insoluble material. Not only resin (ABS resin) in the embodiment but also another water insoluble resin material, glass, ceramic, a metal material, wood, etc. may be used. In addition, resin plating may be performed on the decorative bead toy as described previously. In addition, painting or another surface treatment may be performed.

The invention claimed is:

1. A decorative bead toy comprising:

a body portion made of a water insoluble material and formed into a spheroid using a minor axis as a rotational axis or a shape obtained by cutting the spheroid; and a recess engagement portion provided in the body portion so as to engage a plurality of fusible bead toys made of water soluble resin, wherein the recess engagement portion is a continuous groove provided entirely around an equatorial radius of the body portion.

2. The decorative bead toy according to claim 1, wherein the body portion and the recess engagement portion are formed into multifaceted shapes.

3. The decorative bead toy according to claim 1, wherein the body portion is made of water insoluble resin, and wherein the body portion and the recess engagement portion are plated on the resin.

4. A bead toy set comprising:

the decorative bead toy according to claim 1;

a fusible bead toy made of water soluble resin; and a holding tray having a plurality of recess portions on which the decorative bead toy and the fusible bead toy are allowed to be placed.

* * * * *